US010194253B2

(12) United States Patent
Polinske

(10) Patent No.: US 10,194,253 B2
(45) **Date of Patent: *Jan. 29, 2019**

(54) ANTENNAS FOR HEARING AIDS

(71) Applicant: Starkey Laboratories, Inc., Eden Prairie, MN (US)

(72) Inventor: Beau Jay Polinske, Minneapolis, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/269,315

(22) Filed: Sep. 19, 2016

(65) Prior Publication Data

US 2017/0070829 A1 Mar. 9, 2017

Related U.S. Application Data

(63) Continuation of application No. 14/024,409, filed on Sep. 11, 2013, now Pat. No. 9,451,371, which is a (Continued)

(51) Int. Cl.
*H01Q 1/22* (2006.01)
*H01Q 7/00* (2006.01)
(Continued)

(52) U.S. Cl.
CPC ..... *H04R 25/554* (2013.01); *H01Q 1/22* (2013.01); *H01Q 1/2208* (2013.01);
(Continued)

(58) Field of Classification Search
CPC ..... H04R 25/554
See application file for complete search history.

(56) References Cited

U.S. PATENT DOCUMENTS 3,601,550 A 8/1971 Spracklen
5,390,254 A 2/1995 Adelman
(Continued)

FOREIGN PATENT DOCUMENTS

DE 10236469 B3 2/2004
EP 0382675 A1 8/1990
(Continued)

OTHER PUBLICATIONS

U.S. Appl. No. 11/091,748, filed Mar. 28, 2005, Antennas for Hearing Aids.
(Continued)

*Primary Examiner* — Duc Nguyen
*Assistant Examiner* — Phan Le
(74) *Attorney, Agent, or Firm* — Schwegman Lundberg & Woessner, P.A.

(57) ABSTRACT

An antenna configured in a hybrid circuit provides a compact design for a hearing aid to communicate wirelessly with a system external to the hearing aid. In an embodiment, an antenna includes metallic traces in a hybrid circuit that is configured for use in a hearing aid. The antenna includes contacts in the hybrid circuit to couple the metallic traces to electronic devices in the hybrid circuit. In an embodiment, the metallic traces form a planar coil design having a number of turns of the coil in a substrate in the hybrid circuit. In another embodiment, the metallic traces are included in a flex circuit on a substrate in the hybrid circuit. An antenna configured in a hybrid circuit allows for use in a completely-in-the-canal hearing aid.

20 Claims, 8 Drawing Sheets

Related U.S. Application Data continuation of application No. 13/410,042, filed on Mar. 1, 2012, now abandoned, which is a continuation of application No. 12/550,821, filed on Aug. 31, 2009, now Pat. No. 8,180,080, which is a continuation of application No. 11/357,751, filed on Feb. 17, 2006, now Pat. No. 7,593,538, which is a continuation of application No. 11/287,892, filed on Nov. 28, 2005, now abandoned, which is a continuation of application No. 11/091,748, filed on Mar. 28, 2005, now abandoned.

(51) Int. Cl.
*H01Q 11/08* (2006.01)
*H01Q 23/00* (2006.01)
*H04R 25/00* (2006.01)

(52) U.S. Cl.
CPC ..... *H01Q 1/2283* (2013.01); *H01Q 1/2291* (2013.01); *H01Q 7/00* (2013.01); *H01Q 11/08* (2013.01); *H01Q 23/00* (2013.01); *H04R 2225/023* (2013.01); *H04R 2225/51* (2013.01)

(56) References Cited

U.S. PATENT DOCUMENTS 5,734,976 A 3/1998 Bartschi et al.
5,808,587 A 9/1998 Shima
5,842,115 A 11/1998 Dent
6,041,128 A 3/2000 Narisawa et al.
6,041,129 A 3/2000 Adelman
6,061,037 A 5/2000 Brouwers et al.
6,205,227 B1 3/2001 Mahoney et al.
6,249,256 B1 6/2001 Luxon et al.
6,281,854 B1 8/2001 Ohoka et al.
6,307,945 B1 10/2001 Hall
6,380,896 B1 4/2002 Berger et al.
6,449,461 B1 * 9/2002 Otten ..... H04W 16/14 455/63.1
6,456,720 B1 9/2002 Brimhall et al.
6,459,415 B1 * 10/2002 Pachal ..... H01Q 9/065 343/795
6,473,512 B1 10/2002 Juneau et al.
6,501,437 B1 12/2002 Gyorko et al.
6,546,109 B1 4/2003 Gnecco et al.
6,597,320 B2 7/2003 Maeda et al.
6,603,440 B2 8/2003 Howard
6,674,869 B2 1/2004 Paczkowski
6,724,901 B1 4/2004 Preuthun
6,865,279 B2 3/2005 Leedom
7,142,682 B2 11/2006 Mullenborn et al.
7,265,721 B2 9/2007 Shigehiro et al.
7,289,069 B2 10/2007 Ranta
7,315,290 B2 1/2008 Harada et al.
7,426,279 B2 9/2008 Cochran et al.
7,443,992 B2 10/2008 Fideler
7,450,078 B2 11/2008 Knudsen et al.
7,454,027 B2 11/2008 Sorensen
7,593,538 B2 9/2009 Polinske
7,659,469 B2 2/2010 Belli
7,742,614 B2 6/2010 Christensen et al.
7,777,681 B2 8/2010 Platz
7,859,469 B1 12/2010 Rosener et al.
7,881,486 B1 2/2011 Killion et al.
8,073,173 B2 12/2011 Onodera
8,150,075 B2 4/2012 Abolfathi et al.
8,180,080 B2 5/2012 Polinske et al.
8,494,197 B2 7/2013 Polinske et al.
8,565,457 B2 10/2013 Polinske et al.
8,699,733 B2 4/2014 Polinske et al.
8,737,658 B2 5/2014 Helgeson et al.
9,167,360 B2 10/2015 Polinske et al.
9,179,227 B2 11/2015 Polinske et al.
9,264,826 B2 2/2016 Helgeson et al.
9,294,850 B2 3/2016 Polinske et al.
9,451,371 B2 9/2016 Polinske
9,602,934 B2 3/2017 Sanguino et al.
9,743,199 B2 8/2017 Polinske et al.
2001/0007050 A1 7/2001 Adelman
2002/0000944 A1 * 1/2002 Sabet ..... H01Q 1/36 343/770
2002/0037756 A1 3/2002 Jacobs et al.
2002/0090099 A1 7/2002 Hwang
2003/0122713 A1 7/2003 Morris
2004/0027296 A1 2/2004 Gerber
2004/0028251 A1 2/2004 Kasztelan et al.
2004/0044382 A1 3/2004 Ibrahim
2004/0120540 A1 * 6/2004 Mullenborn ..... H04R 19/005 381/322
2004/0176815 A1 9/2004 Janzig et al.
2004/0196190 A1 10/2004 Mendolia et al.
2005/0099341 A1 * 5/2005 Zhang ..... H01Q 1/273 343/700 MS
2005/0100183 A1 5/2005 Ballisager et al.
2005/0244024 A1 11/2005 Fischer et al.
2005/0253711 A1 * 11/2005 Nelson ..... F41H 11/136 340/552
2006/0055531 A1 3/2006 Cook et al.
2006/0145931 A1 7/2006 Ranta
2006/0227989 A1 10/2006 Polinske
2007/0080889 A1 * 4/2007 Zhang ..... H01Q 1/273 343/895
2007/0086610 A1 4/2007 Niederdrank
2007/0188402 A1 8/2007 Knudsen et al.
2007/0229369 A1 10/2007 Platz
2008/0056520 A1 * 3/2008 Christensen ..... H01Q 1/273 381/323
2008/0095387 A1 4/2008 Niederdrank et al.
2008/0150816 A1 6/2008 Rahola et al.
2008/0272980 A1 11/2008 Adel et al.
2008/0287084 A1 11/2008 Krebs et al.
2009/0041285 A1 2/2009 Parkins et al.
2009/0085819 A1 4/2009 Watanabe
2009/0136068 A1 5/2009 Koo et al.
2009/0214064 A1 8/2009 Wu et al.
2009/0226786 A1 9/2009 Selcuk et al.
2010/0074461 A1 3/2010 Polinske
2010/0158291 A1 6/2010 Polinske et al.
2010/0158293 A1 6/2010 Polinske et al.
2010/0158294 A1 6/2010 Helgeson et al.
2010/0158295 A1 6/2010 Polinske et al.
2010/0171667 A1 7/2010 Knudsen
2010/0202639 A1 8/2010 Christensen et al.
2011/0117974 A1 5/2011 Spitalnik et al.
2011/0228947 A1 9/2011 Killion et al.
2012/0308058 A1 12/2012 Polinske
2014/0016806 A1 1/2014 Polinske
2014/0016807 A1 1/2014 Polinske et al.
2014/0307904 A1 10/2014 Polinske et al.
2014/0348362 A1 11/2014 Helgeson et al.
2015/0016646 A1 1/2015 Polinske et al.
2016/0183013 A1 6/2016 Polinske et al.
2016/0192091 A1 6/2016 Polinske et al.
2016/0337767 A1 11/2016 Helgeson et al.
2016/0345109 A1 11/2016 Polinske et al.
2017/0134870 A1 5/2017 Helgeson et al.
2017/0230768 A1 8/2017 Polinske et al.

FOREIGN PATENT DOCUMENTS

EP 0389559 A1 10/1990
EP 424796 A2 5/1991
EP 0594375 A2 4/1994
EP 1250026 A1 10/2002
EP 1389035 A1 2/2004
EP 1460712 A1 9/2004
EP 1587344 A2 10/2005
EP 1851823 B1 8/2006
EP 1708306 A1 10/2006
EP 1821571 A1 8/2007
EP 1708306 B1 5/2012
EP 2200120 B1 10/2013

(56) References Cited

FOREIGN PATENT DOCUMENTS

| | | | |
|---|---|---|---|
| EP | 2200348 | B1 | 5/2014 |
| JP | 02300894 | A | 12/1990 |
| JP | 2002238098 | A | 8/2002 |
| JP | 2002238100 | A | 8/2002 |
| WO | WO-9213430 | A1 | 8/1992 |
| WO | WO-9306666 | A1 | 4/1993 |
| WO | WO-9731431 | A1 | 8/1997 |
| WO | WO-9949815 | A1 | 10/1999 |
| WO | WO-2001043497 | A1 | 6/2001 |
| WO | WO-0173864 | A2 | 10/2001 |
| WO | WO-0173865 | A2 | 10/2001 |
| WO | WO-0173868 | A2 | 10/2001 |
| WO | WO-0173870 | A2 | 10/2001 |
| WO | WO-0173883 | A2 | 10/2001 |
| WO | WO-0173957 | A2 | 10/2001 |
| WO | WO-2004093002 | A1 | 10/2004 |
| WO | WO-2008023860 | A1 | 2/2008 |

OTHER PUBLICATIONS

U.S. Appl. No. 11/287,892, filed Nov. 28, 2005, Antennas for Hearing Aids.
U.S. Appl. No. 11/357,751, filed Feb. 17, 2006, Antennas for Hearing Aids.
U.S. Appl. No. 12/550,821, filed Aug. 31, 2009, Antennas for Hearing Aids.
U.S. Appl. No. 13/410,042, filed Mar. 1, 2012, Antennas for Hearing Aids.
U.S. Appl. No. 14/024,409, filed Sep. 11, 2013, Antennas for Hearing Aids.
U.S. Appl. No. 12/340,591, filed Dec. 19, 2008, Three Dimensional Substrate for Hearing Assistance Devices.
U.S. Appl. No. 14/287,334, filed May 27, 2014, Three Dimensional Substrate for Hearing Assistance Devices.
U.S. Appl. No. 15/043,800, filed Feb. 15, 2016, Three Dimensional Substrate for Hearing Assistance Devices.
U.S. Appl. No. 13/948,040, filed Jul. 22, 2013, Three Dimensional Substrate for Hearing Assistance Devices.
U.S. Appl. No. 12/340,600, filed Dec. 19, 2008, Antennas for Custom Fit Hearing Assistance Devices.
U.S. Appl. No. 14/886,629, filed Oct. 19, 2008, Antennas for Custom Fit Hearing Assistance Devices.
U.S. Appl. No. 12/340,604, filed Dec. 19, 2008, Antennas for Standard Fit Hearing Assistance Devices.
U.S. Appl. No. 14/031,906, filed Sep. 19, 2013, Antennas for Standard Fit Hearing Assistance Devices.
U.S. Appl. No. 14/927,770, filed Oct. 30, 2015, Antennas for Standard Fit Hearing Assistance Devices.
U.S. Appl. No. 15/463,975, filed Mar. 20, 2017, Antennas for Standard Fit Hearing Assistance Devices.
U.S. Appl. No. 12/638,720, filed Dec. 15, 2009, Parallel Antennas for Standard Fit Hearing Assistance Devices.
U.S. Appl. No. 14/252,398, filed Apr. 14, 2014, Parallel Antennas for Standard Fit Hearing Assistance Devices.
U.S. Appl. No. 15/076,479, filed Mar. 21, 2016, Parallel Antennas for Standard Fit Hearing Assistance Devices.
U.S. Appl. No. 15/413,176, filed Jan. 23, 2017, Three Dimensional Substrate for Hearing Assistance Devices.
"U.S. Appl. No. 11/357,751, Final Office Action dated Feb. 17, 2009", 11 pgs.
"U.S. Appl. No. 11/357,751, Non-Final Office Action dated May 23, 2008", 9 pgs.
"U.S. Appl. No. 11/357,751, Non-Final Office Action dated Aug. 28, 2007", 9 pgs.
"U.S. Appl. No. 11/357,751, Notice of Allowance dated Aug. 5, 2009", 7 pgs.
"U.S. Appl. No. 11/357,751, Preliminary Amendment dated Aug. 28, 2006", 6 pgs.
"U.S. Appl. No. 11/357,751, Response filed Feb. 28, 2008 to Non-Final Office Action dated Aug. 28, 2007", 10 pgs.
"U.S. Appl. No. 11/357,751, Response filed May 18, 2009 to Final Office Action dated Feb. 17, 2009", 9 pgs.
"U.S. Appl. No. 11/357,751, Response filed Nov. 24, 2008 to Non Final Office Action dated May 23, 2008", 13 pgs.
"U.S. Appl. No. 12/340,591, Final Office Action dated Mar. 14, 2012", 7 pgs.
"U.S. Appl. No. 12/340,591, Non Final Office Action dated Sep. 12, 2011", 7 pgs.
"U.S. Appl. No. 12/340,591, Notice of Allowance dated Jan. 21, 2014", 8 pgs.
"U.S. Appl. No. 12/340,591, Notice of Allowance dated Sep. 5, 2013", 9 pgs.
"U.S. Appl. No. 12/340,591, Response filed Jan. 12, 2012 to Non Final Office Action dated Sep. 12, 2011", 7 pgs.
"U.S. Appl. No. 12/340,591, Response filed Aug. 14, 2012 to Final Office Action dated Mar. 14, 2012", 11 pgs.
"U.S. Appl. No. 12/340,600, Final Office Action dated Mar. 27, 2012", 6 pgs.
"U.S. Appl. No. 12/340,600, Non Final Office Action dated Sep. 14, 2011", 6 pgs.
"U.S. Appl. No. 12/340,600, Notice of Allowance dated Mar. 19, 2013", 5 pgs.
"U.S. Appl. No. 12/340,600, Preliminary Amendment filed Apr. 6, 2009", 7 pgs.
"U.S. Appl. No. 12/340,600, Response filed Jan. 17, 2012 to Non Final Office Action dated Sep. 14, 2011", 10 pgs.
"U.S. Appl. No. 12/340,600, Response filed Aug. 27, 2012 to Final Office Action dated Mar. 27, 2012", 8 pgs.
"U.S. Appl. No. 12/340,604, 312 Amendment filed Sep. 19, 2013", 3 pgs.
"U.S. Appl. No. 12/340,604, Final Office Action dated Feb. 21, 2013", 17 pgs.
"U.S. Appl. No. 12/340,604, Final Office Action dated Mar. 1, 2012", 14 pgs.
"U.S. Appl. No. 12/340,604, Non Final Office Action dated Aug. 30, 2012", 15 pgs.
"U.S. Appl. No. 12/340,604, Non Final Office Action dated Oct. 11, 2011", 11 pgs.
"U.S. Appl. No. 12/340,604, Notice of Allowance dated Jun. 19, 2013", 18 pgs.
"U.S. Appl. No. 12/340,604, Preliminary Amendment filed Apr. 6, 2009", 7 pgs.
"U.S. Appl. No. 12/340,604, PTO Response to 312 Amendment dated Sep. 24, 2013", 2 pgs.
"U.S. Appl. No. 12/340,604, Response filed Jan. 11, 2012 to Non Final Office Action dated Oct. 11, 2011", 10 pgs.
"U.S. Appl. No. 12/340,604, Response filed May 21, 2013 to Final Office Action dated Feb. 21, 2013", 9 pgs.
"U.S. Appl. No. 12/340,604, Response filed Aug. 1, 2012 to Final Office Action dated Mar. 1, 2012", 9 pgs.
"U.S. Appl. No. 12/340,604, Response filed Dec. 31, 2012 to Non Final Office Action dated Aug. 30, 2012", 8 pgs.
"U.S. Appl. No. 12/550,821, Non Final Office Action dated Sep. 1, 2011", 9 pgs.
"U.S. Appl. No. 12/550,821, Notice of Allowance dated Mar. 19, 2012", 9 pgs.
"U.S. Appl. No. 12/550,821, Notice of Allowance dated Apr. 10, 2012", 7 pgs.
"U.S. Appl. No. 12/550,821, Response filed Mar. 1, 2012 to Non Final Office Action dated Sep. 1, 2011", 6 pgs.
"U.S. Appl. No. 12/638,720, Final Office Action dated Mar. 2, 2012", 17 pgs.
"U.S. Appl. No. 12/638,720, Non Final Office Action dated Jul. 30, 2013", 23 pgs.
"U.S. Appl. No. 12/638,720, Non Final Office Action dated Oct. 17, 2011", 14 pgs.
"U.S. Appl. No. 12/638,720, Notice of Allowance dated Nov. 27, 2013", 17 pgs.
"U.S. Appl. No. 12/638,720, Response filed Jan. 17, 2012 to Non Final Office Action dated Oct. 17, 2011", 9 pgs.
"U.S. Appl. No. 12/638,720, Response filed Aug. 1, 2012 to Final Office Action dated Mar. 2, 2012", 9 pgs.

(56) References Cited

OTHER PUBLICATIONS

"U.S. Appl. No. 12/638,720, Response filed Oct. 30, 2013 to Non Final Office Action dated Jul. 30, 2013", 10 pgs.
"U.S. Appl. No. 12/638,720, Supplemental Notice of Allowability dated Feb. 4, 2014", 2 pgs.
"U.S. Appl. No. 13/410,042, Non Final Office Action dated Apr. 11, 2013", 10 pgs.
"U.S. Appl. No. 13/948,040, Non Final Office Action dated Dec. 10, 2014", 8 pgs.
"U.S. Appl. No. 13/948,040, Notice of Allowance dated May 28, 2015", 7 pgs.
"U.S. Appl. No. 13/948,040, Preliminary Amendment filed Mar. 13, 2014", (dated Mar. 13, 2014), 6 pgs.
"U.S. Appl. No. 13/948,040, Response filed Mar. 10, 2015 to Non Final Office Action dated Dec. 10, 2014", 9 pgs.
"U.S. Appl. No. 14/024,409, Advisory Action dated Dec. 31, 2015", 3 pgs.
"U.S. Appl. No. 14/024,409, Final Office Action dated Oct. 1, 2015", 12 pgs.
"U.S. Appl. No. 14/024,409, Non Final Office Action dated Jan. 22, 2015", 8 pgs.
"U.S. Appl. No. 14/024,409, Notice of Allowance dated May 23, 2016", 7 pgs.
"U.S. Appl. No. 14/024,409, Pre-Appeal Brief filed Feb. 1, 2016", 3 pgs.
"U.S. Appl. No. 14/024,409, Response filed Jun. 22, 2015 to Non Final Office Action dated Jan. 22, 2015", 6 pgs.
"U.S. Appl. No. 14/024,409, Response filed Dec. 1, 2015 to Final Office Action dated Oct. 1, 2015", 8 pgs.
"U.S. Appl. No. 14/031,906, Advisory Action dated May 20, 2015", 3 pgs.
"U.S. Appl. No. 14/031,906, Final Office Action dated Mar. 11, 2015", 8 pgs.
"U.S. Appl. No. 14/031,906, Non Final Office Action dated Jul. 31, 2014", 7 pgs.
"U.S. Appl. No. 14/031,906, Notice of Allowance dated Jun. 26, 2015", 6 pgs.
"U.S. Appl. No. 14/031,906, Preliminary Amendment filed Sep. 20, 2013", (dated Sep. 20, 2013), 20 pgs.
"U.S. Appl. No. 14/031,906, Response filed May 11, 2015 to Final Office Action dated Mar. 11, 2015", 6 pgs.
"U.S. Appl. No. 14/031,906, Response filed Oct. 30, 2014 to Non Final Office Action dated Jul. 31, 2014", 6 pgs.
"U.S. Appl. No. 14/252,398, Final Office Action dated Aug. 11, 2015", 6 pgs.
"U.S. Appl. No. 14/252,398, Non Final Office Action dated Mar. 5, 2015", 10 pgs.
"U.S. Appl. No. 14/252,398, Notice of Allowance dated Nov. 10, 2015", 6 pgs.
"U.S. Appl. No. 14/252,398, Preliminary Amendment filed Oct. 6, 2014", 5 pgs.
"U.S. Appl. No. 14/252,398, Response filed Jun. 5, 2015 to Non Final Office Action dated Mar. 5, 2015", 7 pgs.
"U.S. Appl. No. 14/252,398, Response filed Oct. 12, 2015 to Final Office Action dated Aug. 11, 2015", 6 pgs.
"U.S. Appl. No. 14/287,334, Final Office Action dated Jul. 30, 2015", 4 pgs.
"U.S. Appl. No. 14/287,334, Non Final Office Action dated Mar. 12, 2015", 8 pgs.
"U.S. Appl. No. 14/287,334, Notice of Allowance dated Oct. 13, 2015", 6 pgs.
"U.S. Appl. No. 14/287,334, Preliminary Amendment filed Aug. 11, 2014", 6 pgs.
"U.S. Appl. No. 14/287,334, Response filed Jan. 10, 2014 to Restriction Requirement dated Nov. 13, 2014", 6 pgs.
"U.S. Appl. No. 14/287,334, Response filed Jun. 12, 2015 to Non Final Office Action dated Mar. 12, 2015", 9 pgs.
"U.S. Appl. No. 14/287,334, Response filed Sep. 30, 2015 to Final Office Action dated Jul. 30, 2015", 4 pgs.
"U.S. Appl. No. 14/287,334, Restriction Requirement dated Nov. 13, 2014", 6 pgs.
"U.S. Appl. No. 14/886,629, Non Final Office Action dated Dec. 28, 2016", 7 pgs.
"U.S. Appl. No. 14/927,770, Non Final Office Action dated Apr. 22, 2016", 9 pgs.
"U.S. Appl. No. 14/927,770, Notice of Allowance dated Nov. 8, 2016", 7 pgs.
"U.S. Appl. No. 14/927,770, Response filed Jul. 20, 2016 to Non Final Office Action dated Apr. 22, 2016", 6 pgs.
"U.S. Appl. No. 15/043,800, Non Final Office Action dated Sep. 23, 2016", 9 pgs.
"U.S. Appl. No. 15/076,479, Corrected Notice of Allowance dated Jul. 25, 2017", 2 pgs.
"U.S. Appl. No. 15/076,479, Final Office Action dated Jan. 17, 2017", 6 pgs.
"U.S. Appl. No. 15/076,479, Non Final Office Action dated Sep. 2, 2016", 8 pgs.
"U.S. Appl. No. 15/076,479, Notice of Allowance dated Apr. 14, 2017", 8 pgs.
"U.S. Appl. No. 15/076,479, Response filed Mar. 6, 2017 to Final Office Action dated Jan. 17, 2017", 6 pgs.
"U.S. Appl. No. 15/076,479, Response filed Dec. 1, 2016 to Non Final Office Action dated Sep. 2, 2016", 7 pgs.
"U.S. Appl. No. 15/463,975 Preliminary Amendment filed Apr. 28, 2017", 5 pgs.
"U.S. Appl. No. 15/463,975, Non Final Office Action dated Sep. 19, 2017", 11 pgs.
"European Application Serial No. 06251644.8, European Office Action dated Mar. 11, 2008", 4 pgs.
"European Application Serial No. 06251644.8, European Search Report dated Jun. 21, 2006", 5 pgs.
"European Application Serial No. 06251644.8, Office Action dated May 11, 2007", 1 pg.
"European Application Serial No. 06251644.8, Response filed Sep. 22, 2008 to Office Action dated Mar. 11, 2008", 3 pgs.
"European Application Serial No. 06251644.8, Response filed Nov. 21, 2007 to Office Action dated May 11, 2007", 44 pgs.
"European Application Serial No. 06251644.8, Search Report dated Jun. 15, 2006", 2 pgs.
"European Application Serial No. 06251644.8, Summon to attend Oral Proceeding dated Mar. 15, 2011", 4 pgs.
"European Application Serial No. 06251644.8, Written Submissions filed Jun. 1, 2011 in response to Summon to attend Oral Proceeding dated Mar. 15, 2011", 25 pgs.
"European Application Serial No. 09252775.3, Examination Notification dated Jan. 22, 2013".
"European Application Serial No. 09252775.3, Extended European Search Report dated Apr. 19, 2010", 6 pgs.
"European Application Serial No. 09252775.3, Response filed May 28, 2013 to Examination Notification Art. 94(3) dated Jan. 22, 2013", 12 pgs.
"European Application Serial No. 09252775.3, Response filed Dec. 22, 2010 to Search Report dated Apr. 23, 2010", 14 pgs.
"European Application Serial No. 09252796.9, Examination Notification Art. 94(3) dated Mar. 13, 2013", 4 pgs.
"European Application Serial No. 09252796.9, Extended European Search Report dated May 24, 2011", 6 Pgs.
"European Application Serial No. 09252796.9, Response filed Jul. 4, 2013 to Office Action dated Mar. 13, 2013", 9 pgs.
"European Application Serial No. 09252796.9, Response filed Dec. 14, 2011 to Search Report dated Jun. 28, 2011", 7 pgs.
"European Application Serial No. 09252830.6, Extended European Search Report dated May 24, 2011", 6 pgs.
"European Application Serial No. 09252830.6, Extended Search Report Response filed Dec. 15, 2011", 9 pgs.
Chen, W T, et al., "Numerical computation of the Em coupling between a circular loop antenna and a full-scale human-body model", IEEE Transactions on Microwave Theory and Techniques, 46(10), (Oct. 1998), 1516-1520.
"U.S. Appl. No. 15/413,176, Non Final Office Action dated Jan. 10, 2018", 11 pgs.

(56) References Cited

OTHER PUBLICATIONS

"U.S. Appl. No. 15/463,975, Final Office Action dated Apr. 13, 2018", 12 pgs.
"U.S. Appl. No. 15/463,975, Response filed Dec. 19, 2017 to Non Final Office Action dated Sep. 19, 2017", 7 pgs.
"U.S. Appl. No. 15/463,975, Response filed Jun. 6, 2018 to Final Office Action dated Apr. 13, 2018", 7 pgs.
"U.S. Appl. No. 15/463,975, Advisory Action dated Jun. 26, 2018", 3 pgs.
"U.S. Appl. No. 15/413,176, Response filed Jul. 10, 2018 to Non Final Office Action dated Jan. 10, 2018", 5 pgs.
"U.S. Appl. No. 15/413,176, Notice of Allowance dated Jul. 26, 2018", 5 pgs.
"U.S. Appl. No. 15/463,975, Non Final Office Action dated Aug. 9, 2018", 12 pgs.

* cited by examiner

ANTENNAS FOR HEARING AIDS

CROSS-REFERENCE TO RELATED APPLICATIONS

This application is a continuation of U.S. application Ser. No. 14/024,409, filed Sep. 11, 2013, which is a continuation of U.S. application Ser. No. 13/410,042, filed on Mar. 1, 2012, which application is a continuation of U.S. application Ser. No. 12/550,821, filed on Aug. 31, 2009, now issued as U.S. Pat. No. 8,180,080, which is a continuation of U.S. application Ser. No. 11/357,751, filed on Feb. 17, 2006, now issued as U.S. Pat. No. 7,593,538, which is a continuation of U.S. application Ser. No. 11/287,892, filed on Nov. 28, 2005, which is a continuation of U.S. application Ser. No. 11/091,748, filed on Mar. 28, 2005, which applications are incorporated herein by reference in their entirety.

FIELD OF THE INVENTION

This invention relates generally to antennas, more particularly to antennas for hearing aids.

BACKGROUND

Hearing aids can provide adjustable operational modes or characteristics that improve the performance of the hearing aid for a specific person or in a specific environment. Some of the operational characteristics are volume control, tone control, and selective signal input. These and other operational characteristics can be programmed into a hearing aid. A programmable hearing aid can be programmed through connections to the hearing aid and by wirelessly communicating with the hearing aid.

Generally, hearing aids are small and require extensive design to fit all the necessary electronic components into the hearing aid or attached to the hearing aid as is the case for an antenna for wireless communication with the hearing aid. The complexity of the design depends on the size and type of hearing aids. For completely-in-the-canal (CIC) hearing aids, the complexity can be more extensive than for in-the-ear (ITE) hearing aids or behind-the-ear (BTE) hearing aids due to the compact size required to fit completely in the ear canal of an individual.

SUMMARY OF THE INVENTION

Upon reading and understanding the present disclosure it is recognized that embodiments of the inventive subject matter described herein satisfy the foregoing needs in the art and several other needs in the art not expressly noted herein. The following summary is provided to give the reader a brief summary that is not intended to be exhaustive or limiting and the scope of the invention is provided by the attached claims and the equivalents thereof.

In an embodiment, an antenna includes metallic traces in a hybrid circuit that is configured for use in a hearing aid. The antenna includes contacts to connect the metallic traces to electronic circuitry of the hearing aid. In an embodiment, the metallic traces form a planar coil design having a number of turns of the coil in a substrate in the hybrid circuit. In another embodiment, the metallic traces are included in a flex circuit on a substrate in the hybrid circuit.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

BRIEF DESCRIPTION OF THE DRAWINGS

A more complete understanding of the invention and its various features may be obtained from a consideration of the following detailed description, the appended claims, and the attached drawings.

DETAILED DESCRIPTION

The following detailed description refers to the accompanying drawings that form a part hereof and that show, by way of illustration, specific details and embodiments in which the invention may be practiced. These embodiments are described in sufficient detail to enable those skilled in the art to practice and use the present invention. Other embodiments may be utilized and structural, logical, and electrical changes may be made without departing from the spirit and scope of the present invention. The various embodiments disclosed herein are not necessarily mutually exclusive, as embodiments can be combined with one or more other embodiments to form new embodiments. The following detailed description is, therefore, not to be taken in a limiting sense, and the scope of the embodiments of the present invention is defined only by the appended claims, along with the full scope of equivalents to which such claims are entitled.

A hearing aid is a hearing device that generally amplifies or processes sound to compensate for poor hearing and is typically worn by a hearing impaired individual. In some instances, the hearing aid is a hearing device that adjusts or modifies a frequency response to better match the frequency dependent hearing characteristics of a hearing impaired individual. Individuals may use hearing aids to receive audio data, such as digital audio data and voice messages, which may not be available otherwise for those seriously hearing impaired.

In an embodiment, a circuit includes an antenna configured in a hybrid circuit for use in a hearing aid. In an embodiment, a circuit includes metallic traces in a hybrid circuit configured for use as an antenna in a hearing aid and contacts in the hybrid circuit to connect the metallic traces to electronic devices in the hybrid circuit. Such an antenna may be visualized as being embedded in the hybrid like layers of a sandwich. In general, a hybrid circuit is a collection of electronic components and one or more substrates bonded together, where the electronic components include one or more semiconductor circuits. In some cases, the elements of the hybrid circuit are seamlessly bonded together. In an embodiment, a hybrid circuit configured for use in a hearing aid includes one or more ceramic substrates. In an embodiment, a hybrid circuit configured for use in a hearing aid has a substrate on which an antenna is disposed, where the substrate has a dielectric constant ranging from about 3 to about 10. In various embodiments, the substrate may have a dielectric constant less than 3 or a dielectric constant greater than 10.

Figure 1:
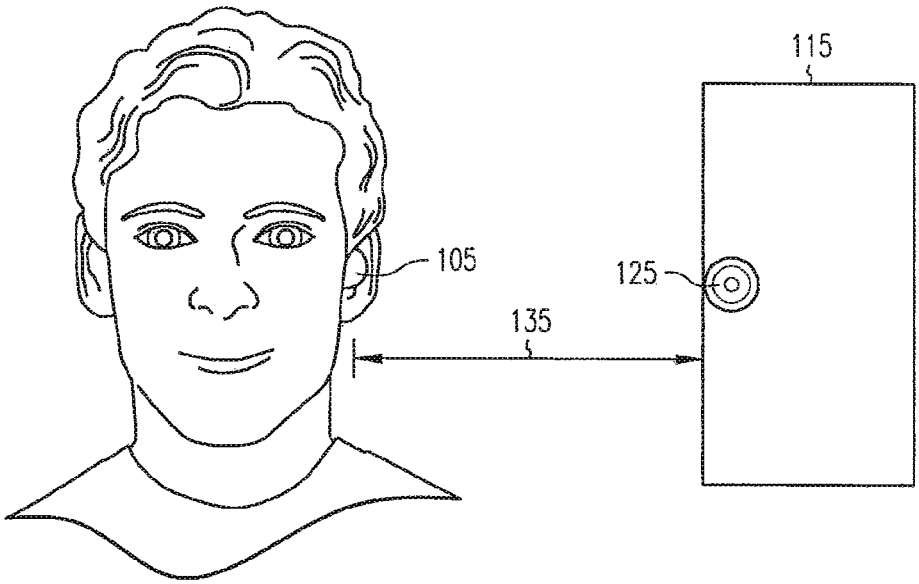
FIG. 1 depicts an embodiment of a hearing aid having an antenna for wireless communication with a device exterior to the hearing aid, in accordance with the teachings of the present invention.

FIG. 1 depicts an embodiment of a hearing aid 105 having an antenna for wireless communication with a device 115 exterior to the hearing aid. Exterior device 115 includes an antenna 125 for communicating information with hearing aid 105. In an embodiment, hearing aid 105 includes an antenna having a working distance 135 ranging from about 2 meters to about 3 meters. In an embodiment, hearing aid 105 includes an antenna having working distance 135 ranging to about 10 meters. In an embodiment, hearing aid 105 includes an antenna that operates at about −10 dBm of input power. In an embodiment, hearing aid 105 includes an antenna operating at a carrier frequency ranging from about 400 MHz to about 3000 MHz. In an embodiment, hearing aid 105 includes an antenna operating at a carrier frequency of about 916 MHz. In an embodiment, hearing aid 105 includes an antenna operating at a carrier frequency of about 916 MHz with a working distance ranging from about 2 meters to about 3 meters for an input power of about −10 dBm.

Figure 2A:
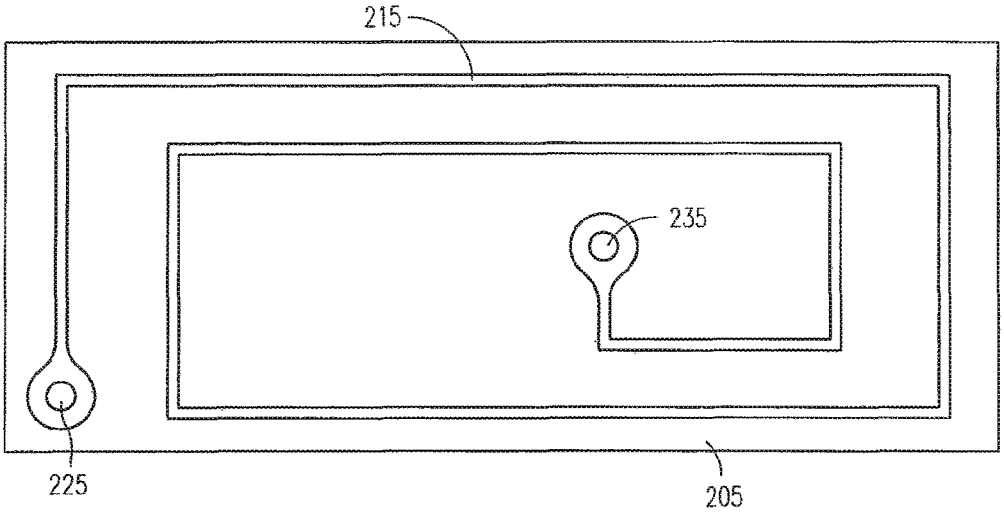
FIGS. 2A-2B show overviews of embodiments of an antenna in a substrate for inclusion in a hybrid circuit configured for use in a hearing aid, in accordance with the teachings of the present invention.

FIG. 2A shows an overview of an embodiment of an antenna circuit on a substrate 205 for inclusion in a hybrid circuit configured for use in a hearing aid. The antenna of FIG. 2A includes a metallic trace 215 having a number of turns. A turn is a traversal along a path that can be projected on a plane such that the traversal is substantially around the supporting substrate of the antenna. In an embodiment, metallic trace 215 has two to three turns on one layer. In an embodiment, metallic trace 215 has two and one half turns on one layer. Various embodiments for an antenna may use any number of integral turns or partial turns. Contacts 225 and 235 provide electrical coupling to electronic devices of the hybrid circuit. Contacts 225 and 235 may be configured as a plated through-hole or via connecting metallic trace 215 on one layer of substrate 205 to various electronic components of the hybrid circuit on another layer or another substrate. As illustrated in FIG. 2A, an embodiment for an antenna includes metallic traces that form a planar coil design with a helical coil component. The helical coil component is provided by a number of turns that advance a finite distance inward as the number of turns increase. This configuration of turns generates a planar spiral shape providing the antenna with an elliptical polarization. Having elliptical polarization characteristics decreases the intensity of the nulls in the antenna pattern, allowing reception of signals close to the antenna null.

Figure 2B:
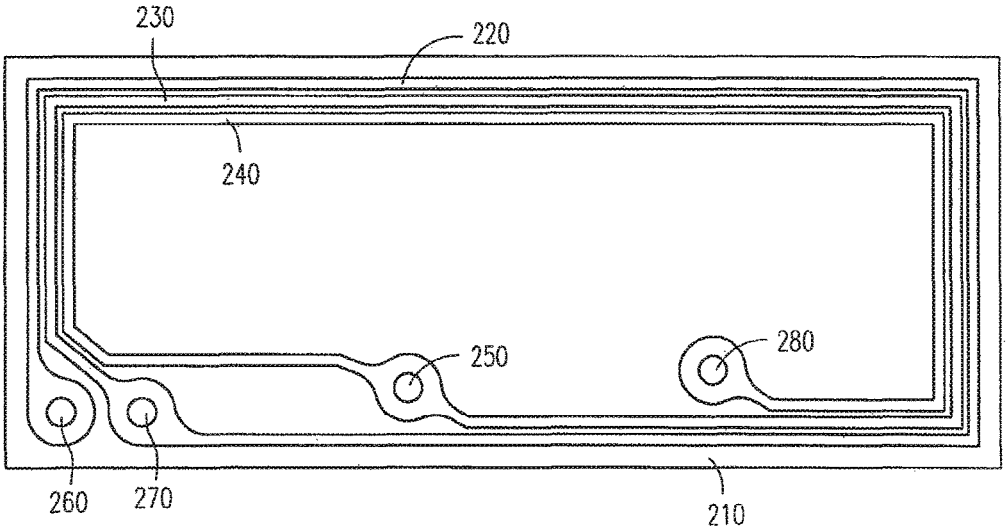

FIG. 2B shows an overview of another embodiment of an antenna circuit on a substrate 210 for inclusion in a hybrid circuit configured for use in a hearing aid. The antenna of FIG. 2B includes a metallic trace having a layer of turns 220, a layer of turns 230, and a layer of turns 240. In an embodiment, layer of turns 220 and layer of turns 240 are on one side of substrate 210 and layer of turns 230 is on the opposite side of substrate 210 with a plated through-hole or via 250 connecting layer of turns 240 to layer of turns 230. Additional vias 260, 270, and 280 allow the antenna to be coupled to electronic components of the hybrid circuit. Alternatively, each layer of turns 220, 230, and 240 are on different layers of substrate 210 and are connected to form a single antenna by vias 250 and 270 with vias 260 and 280 connecting the antenna to one or more electronic devices in the hybrid circuit. In an embodiment, the metallic traces of the antenna have a loop configuration having two ends, each of the two ends to couple to an electronic circuit in the hybrid circuit. As illustrated in FIG. 2B, an embodiment for an antenna includes metallic traces that form a planar coil design with a helical coil component. The helical coil component is provided by a number of turns that advance a finite distance as the number of layer of turns advance. This configuration of turns generates a spiral shape providing the antenna with an elliptical polarization. Having elliptical polarization characteristics decreases the intensity of the nulls in the antenna pattern, allowing reception of signals close to the antenna null.

In an embodiment as shown in FIG. 2A or 2B, the metal traces have a total length of about 1.778 inches, a thickness of about 0.003 inches, and a DC resistance of about 0.56 ohms. In an embodiment, an antenna in the configuration of FIG. 2A has an outline size of about 0.212 inches by 0.126 inches by 0.003 inches. In an embodiment, an antenna in the configuration of FIG. 2B includes three layers of turns of a coil having a total thickness of 0.003 inches.

In an embodiment, the metallic traces of the antenna in a hybrid circuit include a number of turns of a coil on the hybrid circuit. The number of turns of the coil may be on one layer or on several layers in the hybrid circuit. In an embodiment, losses for the antenna are minimized using short trace lengths and a wider trace. Thicker traces may be used to hold down inductance. In an embodiment, inductance is held down to less than 14 nanohenrys for a self resonant frequency of an antenna tuned to about 1.5 GHz. In an embodiment, the metallic traces have a width and a combined length to provide a selected operating distance for a selected input power. In an embodiment, the metallic traces have a width and a combined length to provide a operating distance ranging from about 2 meters to about 3 meters for an input power ranging from about −10 dBm to about −20 dBm. In an embodiment, the traces are silver traces. In another embodiment, the traces are silver and/or copper traces. In another embodiment, the traces are gold traces. The traces may be an appropriate conductive material selected for a given application. As can be understood by those skilled in the art upon reading and studying this disclosure, other metallic materials can be used as well as varying number of layers of turns and varying layers in the hybrid circuit on which the metallic traces are disposed.

Embodiments for antennas in a hearing aid such as those of FIGS. 2A and 2B may be configured with other electronic devices for control of wireless transmission of data to a hearing aid. In an embodiment, a capacitor is coupled in parallel to the metallic traces of an antenna such as the antenna shown in FIG. 2A or 2B. In an embodiment, a capacitor coupled in parallel to the metallic traces of the antenna is part of a match filter. In an embodiment, the antenna is configured to operate with a carrier frequency ranging from about 400 MHz to about 3000 MHz. In an embodiment, the metallic traces of the antenna are coupled to a match circuit. The match circuit may be realized using different approaches including but not limited to using a transformer, a balun, a LC (inductive/capacitive) match circuit, a shunt capacitor, and/or a shunt capacitor and a series capacitor. In an embodiment, an antenna is configured with a balun in a hybrid circuit in the hearing aid. The balun provides a balanced transmission line coupled to an unbalanced transmission line.

Substrate 205 of FIG. 2A and substrate 210 of FIG. 2B include a dielectric insulating material between the traces forming a planar coil and a coil, respectively, as an antenna. The properties of the material in which the antenna is formed determine the velocity of the radiation in the material as well as the portion radiated from the antenna. The dielectric insulating material is chosen to reduce the length of the antenna in the hybrid circuit to be used in a hearing aid. In an embodiment, a substrate for an antenna in a hearing aid is a polyimide having a permittivity of about 3.9 providing the dielectric material between the turns of the antenna. In an embodiment, a substrate for an antenna in a hearing aid is a quartz substrate. In an embodiment, a substrate for an antenna in a hearing aid is a ceramic substrate. In an embodiment, a substrate for an antenna in a hearing aid is an alumina substrate. In an embodiment, dielectric material in which the antenna is embedded is a low temperature cofired ceramic (LTCC). In an embodiment, dielectric material in which the antenna is embedded has a dielectric constant ranging from about 3 to about 10. In an embodiment, a substrate is selected from insulating materials such that the total length of an antenna in a hybrid circuit for a hearing aid is less than approximately 0.2 inches.

Figure 3A:
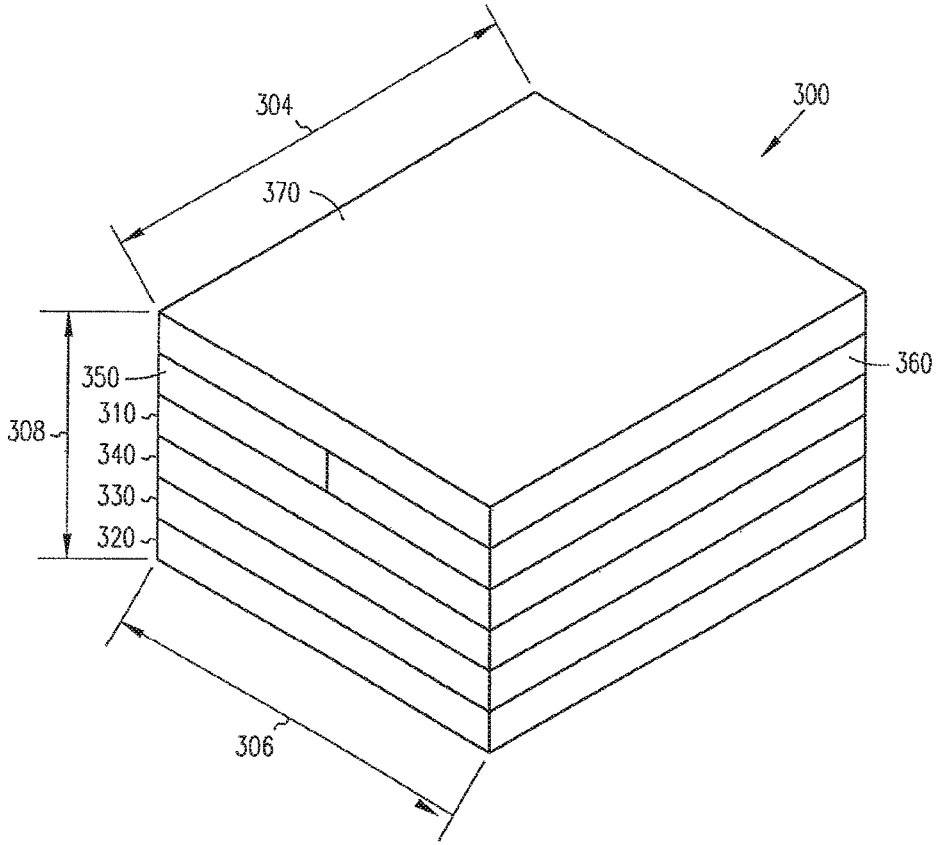
FIG. 3A depicts an embodiment of a hybrid circuit configured for use in a hearing aid including a substrate containing a planar antenna, in accordance with the teachings of the present invention.

FIG. 3A depicts an embodiment of a hybrid circuit 300 configured for use in a hearing aid including a substrate 310 containing a planar antenna. Various embodiments configured as similar to that shown in FIG. 2A or 2B may be used with an antenna layer 310 or 370. In an embodiment, the antenna may include two or three turns in a single plane. In an embodiment, the antenna may include two or three loops in two or three separate planes. In an embodiment, the antenna may include any number of fractional turns. In an embodiment, the antenna may include any number of fractional turns between zero turns and three turns.

Hybrid circuit 300 includes several layers in addition to substrate 310 containing the antenna circuit. Hybrid circuit 300 includes a foundation substrate 320, hearing aid processing layer 330, device layer 340 containing memory devices, and a layer having a radio frequency (RF) chip 350 and crystal 360. Crystal 360 may be shifted to another location in hybrid circuit 300 and replaced with a surface acoustic wave (SAW) device. The SAW device, such as a SAW filter, may be used to screen or filter out noise in frequencies that are close to the wireless operating frequency.

Hearing aid processing layer 330 and device layer 340 provide the electronics for signal processing, memory storage, and sound amplification for the hearing aid. In an embodiment, the amplifier and other electronics for a hearing may be housed in a hybrid circuit using additional layers or using less layers depending on the design of the hybrid circuit for a given hearing aid application. In an embodiment, electronic devices may be formed in the substrate containing the antenna circuit. The electronic devices may include one or more application specific integrated circuits (ASICs) designed to include a matching circuit to couple to the antenna or antenna circuit. The layers of hybrid circuit 300 are bonded together or held together such that contacts of antenna layer 310 can be coupled directly to contacts for other electronic devices in hybrid circuit 300.

Hybrid circuit 300 provides a compact layout for application in a hearing aid. In an embodiment, hybrid circuit 300 has a thickness 308 of approximately 0.089 inches, a width 304 of about 0.100 inches, and a length 306 of approximately 0.201 inches. In an embodiment, hybrid circuit 300 has a thickness 308 less than approximately 0.100 inches, a width 304 of about 0.126 inches, and a length 306 of approximately 0.212 inches. In an embodiment, antenna layer 310 is a polyimide substrate having metallic traces configured as the antenna with a total length of about 1.778 inches and a DC resistance of about 0.56 ohms. The metallic traces may include silver traces, silver and copper traces, and/or copper traces. In an embodiment, antenna layer 310 is a polyimide substrate having metallic traces configured as the antenna, where the antenna layer 310 has a thickness of about 0.003 inches and the antenna has an outline size, as laid around substrate 310 of approximately 0.212 inches by 0.126 inches by 0.003 inches. The antenna is shaped to provide a working distance of about 2 to 3 meters at an input power ranging from about −10 dBm to about −20 dBm. A capacitor with an area of approximately 0.020 inches by 0.010 inches and a capacitance of about 5.2 pF is coupled to the two ends of the antenna to balance or match the antenna. The capacitor can be located on substrate 310 or on one of the other layers of hybrid circuit 300.

An antenna in a hybrid circuit exhibits a complex impedance to the electronics to which it is coupled. For proper operation, the antenna is coupled to a matching circuit to provide impedance matching to the antenna circuit. In an embodiment, the matching circuit is adapted to the complex conjugate of the antenna complex impedance. The matching circuit may be a matching filter, also referred to as a match filter. A match filter can include several electronic components or a single capacitor depending on the application. In an embodiment, the antenna is coupled to a match filter consisting of a capacitor with an area of approximately 0.020 inches by 0.010 inches and a capacitance of about 5.2 pF. In other embodiments, a match filter may include one or more inductors and/or capacitors. The physical and electrical characteristics of the components selected for the match filter depend on the complex impedance provided by the design of the antenna. The length, width, thickness, and material composition for the components of the antenna and match filter are selected to match the complex impedance of the antenna. In an embodiment, the length, width, thickness, and material composition for the components of an antenna are selected for a circuit having metallic traces in a hybrid circuit configured for use as an antenna in a CIC hearing aid.

Figure 3B:
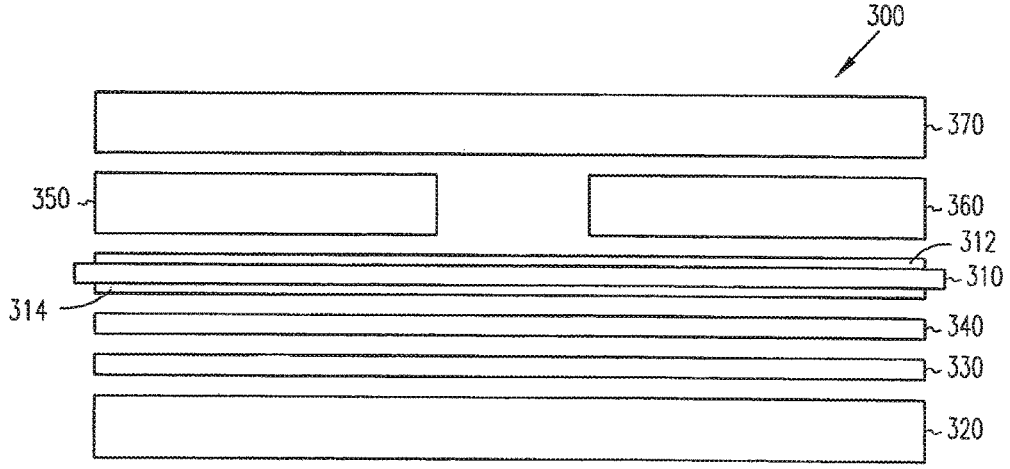
FIG. 3B depicts an expanded view of the embodiment of layers of a hybrid circuit configured for use in a hearing aid shown in FIG. 3A illustrating the planar antenna in a substrate in the hybrid circuit, in accordance with the teachings of the present invention.

FIG. 3B depicts a view of the embodiment of layers of hybrid circuit 300 configured for use in a hearing aid shown in FIG. 3A illustrating the planar antenna on a substrate in the hybrid circuit. FIG. 3B demonstrates that the antenna configured integral to a hybrid circuit for a hearing aid can be essentially directly coupled to electronic devices and circuitry of the hearing aid with the bonding or bringing together of the layers of hybrid circuit 300. In an embodiment, metallic traces 312 are in substrate 310 in a single layer, and hence do not protrude as a separate layer above the surface of substrate 310. Alternatively, metallic traces 312 may protrude above the surface of substrate 310 with appropriate insulation to avoid unwanted electrical coupling. Metallic traces 312 have ends that can connect to electronic devices on layers above and below antenna layer 310, respectively, as well as electronic devices on layer 310. Alternatively, an antenna for hybrid circuit 300 includes metallic traces 312 and metallic traces 314 in different layers of substrate 310, which do not protrude as separate layers above or below the surfaces of substrate 310. Alternatively, metallic traces 312 and metallic traces 314 may protrude above or below the surfaces of substrate 310 with appropriate insulation to avoid unwanted electrical coupling. Metallic traces 312 and 314 have ends that can connect to electronic devices on layers above and below antenna layer 310, respectively, as well as electronic devices on layer 310. The configuration of FIG. 3B eliminates the problems associated with connecting an exterior antenna to components of a hearing aid. Alternatively, hybrid circuit 300 can be configured with a housing such that layers 320, 310, 330, 340, 350, and 360 are spaced apart with electrical connections provided by wiring between the layers. Embodiments for an antenna formed in the hybrid provides for a compact design that can be implemented in the smallest type hearing aid as well as other typical hearing aid types.

Figure 4A:
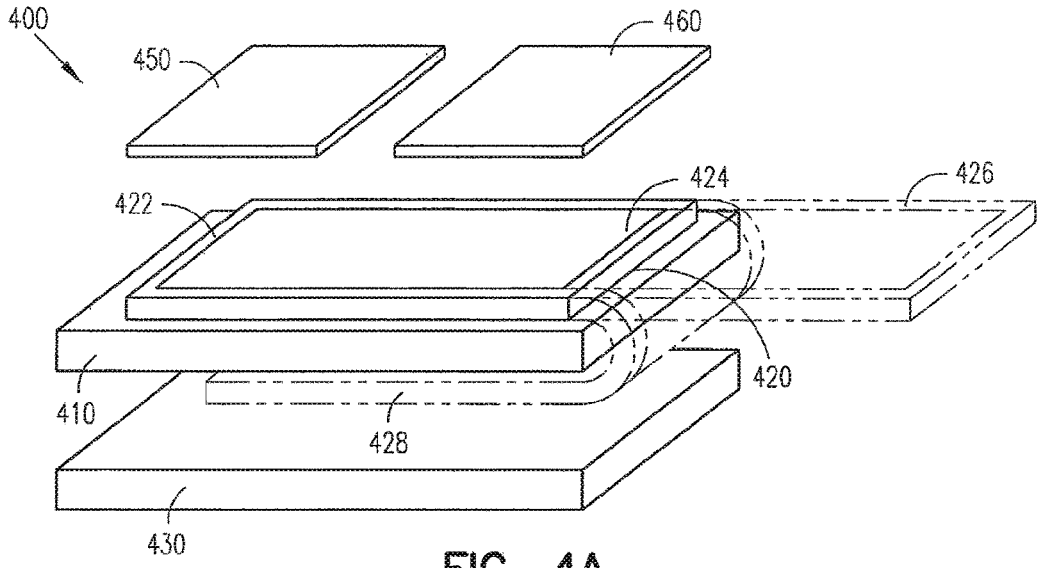
FIG. 4A depicts layers of an embodiment of a hybrid circuit configured for use in a hearing aid including a substrate on which a flex antenna is disposed, in accordance with the teachings of the present invention.

FIG. 4A depicts layers of an embodiment of a hybrid circuit 400 configured for use in a hearing aid including a substrate 410 on which a flex antenna 420 is disposed. The layers of FIG. 4 may be bonded together to provide a hybrid circuit configured similar to hybrid circuit 300 of FIG. 3A. Hybrid circuit 400 includes a foundation layer 430 containing electronic devices and circuitry for a hearing aid, and a layer having an RF electronic chip 450 and crystal 460. Alternatively, foundation layer 430 can be configured in multiple layers similar to layers 320, 330, and 340 of FIG. 3A, B. Crystal 460 may be positioned at another location in hybrid circuit 400 and replaced at the position in FIG. 4A with a SAW device.

In an embodiment as illustrated in FIG. 4A, an antenna layer including a flex antenna 420 disposed on substrate 410 provides an embodiment for an antenna in a hybrid circuit for use in a hearing aid different than the antenna layer 310 of hybrid circuit 300 illustrated in FIG. 3B. Flex antenna 420 uses a flex circuit, which is a type of circuitry that is bendable. The bendable characteristic is provided by forming the circuit as thin conductive traces in a thin flexible medium such as a plastic like material or other flexible dielectric material. Flex antenna 420 includes flexible conductive traces 422 in a flexible dielectric layer 424. In an embodiment, flex antenna 420 is disposed on substrate 410 on a single plane or layer. In an embodiment, flex antenna 420 may have an extension 426 that extends out from substrate 410 into the hearing aid shell (housing). In an alternative embodiment, flex antenna 420 may have a portion 428 that curls around substrate 410 such that it is disposed on two opposite sides of substrate 410. In an embodiment, a hybrid circuit configured for use in a hearing aid includes an antenna configured as a flex circuit having thin metallic traces in a polyimide. Such a flex design may be realized with an antenna layer or antenna layers of the order of about 0.003 inch thick. A flex design may be realized with a thickness of about 0.006 inches. Such a flex design may be realized with antenna layers of the order of about 0.004 inch thick. A flex design may be realized with a thickness of about 0.007 inches as one or multiple layers.

Figure 4B:
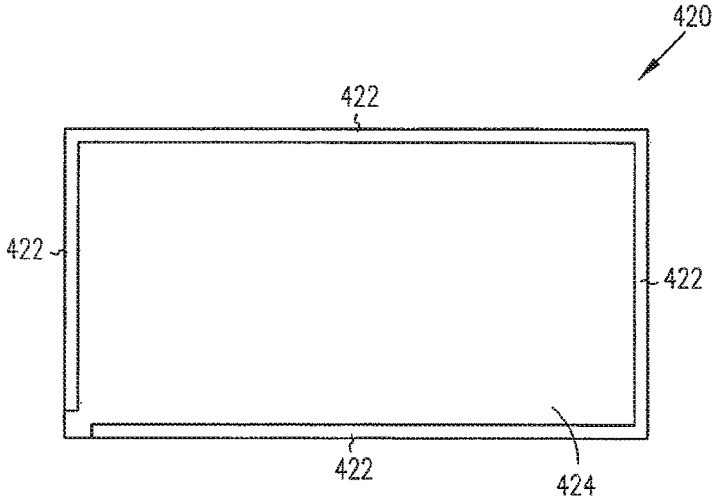
FIG. 4B illustrates an embodiment for the flex antenna that is configured as a layer in the hybrid circuit of FIG. 4A, in accordance with the teachings of the present invention.

FIG. 4B illustrates an embodiment for flex antenna 420 that is configured as a single layer in hybrid circuit 400 of FIG. 4A. Flex antenna 420 includes a conductive layer 422 in or on a dielectric layer 424. Conductive layer 422 may include a metallic layer formed as metallic traces connected together or as one trace having a length equal to the combined length of a conductive layer formed as connected metallic traces. In an embodiment, conductive layer 422 is configured as metallic traces having a rectangular loop configuration for use as an antenna. In another embodiment, conductive layer 422 is configured as a metallic trace having an approximate circular or elliptic loop configuration for use as an antenna. The conductive layer 422 can be formed in other shapes depending on the application in which an antenna is configured. In an embodiment, the conductive layer 422 can be formed as multiple rectangular loops, one inside another. In an embodiment, the conductive layer 422 can be formed as two rectangular loops, one inside another. In an embodiment, conductive layer 422 may be formed as two turns in flex antenna 420. The metallic traces forming conductive layer 422 may be thin layers of silver, copper, gold, or various combinations of these metals. In various embodiments, appropriate conductive material for a given antenna application forms conductive layer 422.

Figure 4C:
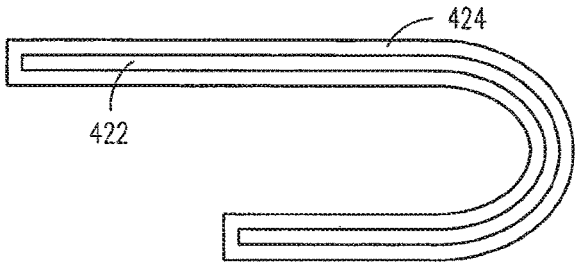
FIG. 4C depicts an embodiment for a flex antenna, in accordance with the teachings of the present invention.

Dielectric layer 424 of flex antenna 420 is a flexible dielectric material. It provides insulation for conductive layer 422 and adaptability of flex antenna 420 to a substrate 410. Flex antenna 420 can be disposed on substrate 410 or curled around substrate 410 as illustrated in FIG. 4A. In an embodiment, dielectric layer 424 is a polyimide material. In an embodiment for a flex antenna, as shown in FIG. 4C, a thin conductive layer 422 is formed in or on thin dielectric layer 424, where dielectric layer 424 has a width slightly larger than the width of conductive layer 422 for configuration as an antenna. Such an arrangement may be effectively wrapped around a substrate. An antenna having such a configuration can be curled around substrate 410 of FIG. 4A such that it has two layers of turns on one side of substrate 410 and one layer of turns on the opposite side of substrate 410. In an embodiment, substrate 410 is a quartz substrate. In an embodiment, substrate 410 is a ceramic substrate. In an embodiment, substrate 410 is an alumina substrate. In an embodiment, substrate 410 has a dielectric constant ranging from about 3 to about 10. Disposing flex antenna 420 on substrate 410 and curling it around substrate 420 provides a antenna for hybrid circuit 400 that is essentially planar with a helical component.

Hybrid circuit 400 and flex antenna 420 of FIG. 4A can be designed with similar characteristics for operation and configuration as the planar antenna of FIGS. 2A and 2B as used in FIG. 3A. In an embodiment, hybrid circuit 400 has a thickness of approximately 0.089 inches, a width of about 0.100 inches, and a length of approximately 0.201 inches. In an embodiment, hybrid circuit 400 has a thickness less than approximately 0.100 inches, a width of about 0.126 inches, and a length of approximately 0.212 inches. In an embodiment substrate 410 and flex antenna 420 form an antenna layer configured with the antenna having a total length of about 1.778 inches and a DC resistance of about 0.56 ohms. In an embodiment, flex antenna 420 has metallic traces 422 having a thickness of about 0.003 inches, where flex antenna 420 has an outline size, as laid out at around substrate 410, of approximately 0.212 inches by 0.126 inches by 0.003 inches. The antenna is shaped to provide a working distance of about 2 to 3 meters at an input power ranging from about −10 dBm to about −20 dBm.

Figure 5:
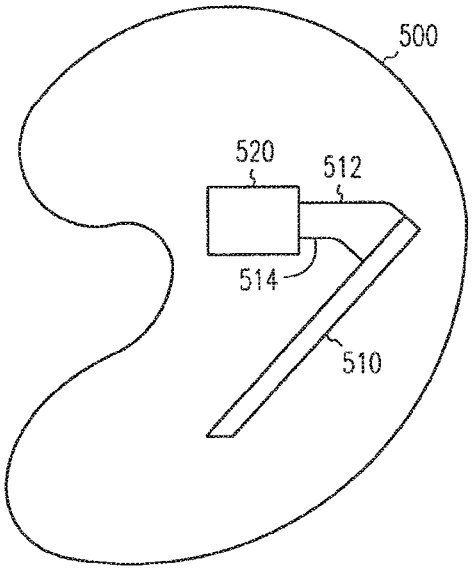
FIG. 5 illustrates an embodiment an antenna coupled to a circuit within a hearing aid, in accordance with the teachings of the present invention.

FIG. 5 depicts an embodiment of a helical antenna 510 coupled to a hybrid circuit 520 in a hearing aid 500. Hybrid circuit 520 and helical antenna 510 are arranged in a common housing for hearing aid 500. A wide range for the number of turns may be used to configure helical antenna 510. Helical antenna 510 may be formed as conductive traces layered in a dielectric medium. In an embodiment, the dielectric medium is alumina. In another embodiment, the dielectric medium is quartz. In another embodiment, the dielectric medium is a LTCC. In an embodiment, the dielectric medium has a dielectric constant ranging from about 3 to about 10. In an embodiment, helical antenna 510 is configured as a 12 turn helix. In an embodiment, helical antenna 510 is configured as a 20 turn helix. The 20 turn helix may be configured to provide a 10 meter working distance. Various embodiments may include any number of turns and are not limited to 12 or 20 turns.

In an embodiment, helical antenna 510 may be coupled to the hybrid circuit 520 by lead connections 512, 514. In an embodiment, each lead connection 512, 514 has a length of about ⅜ inches. Other lengths for lead connections 512, 514 may be implemented depending on the embodiment for hearing aid 500. In an embodiment, hearing aid 500 having antenna 510 adapted to have working distance extending to about 10 meters can be configured with additional circuitry including memory and controllers, or processors, to allow hearing aid 500 to communicate with electronic devices within the 10 meter working distance. Such a configuration allows for reception of such signals as broadcast radio. In other embodiments, hearing aid 500 has an internal antenna that allows hearing aid 500 to communicate and/or receive signals from sources at various distances depending on the application. Hearing aid 500 may be programmed for the selective use of its wireless communication capabilities.

Figure 6:
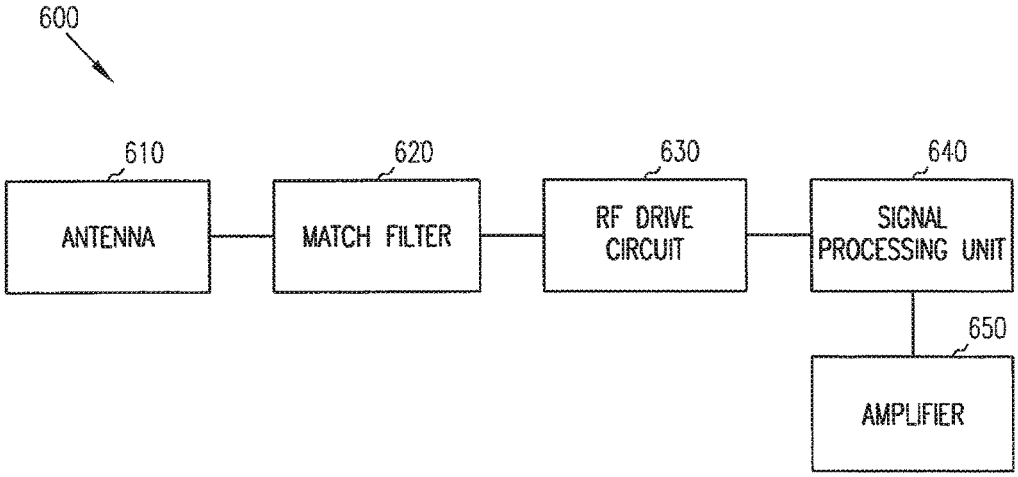
FIG. 6 shows a block diagram of an embodiment of a hybrid circuit configured for use in a hearing aid, in accordance with the teachings of the present invention.

FIG. 6 shows a block diagram of an embodiment of a hybrid circuit 600 configured for use in a hearing aid. Hybrid circuit 600 includes an antenna 610, a match filter 620, an RF drive circuit 630, a signal processing unit 640, and an amplifier 650. Physically, hybrid circuit 600 can be realized as a single compact unit having an integrated antenna, where the antenna can be configured as an embodiment of a substrate based planar antenna, similar to that depicted in FIGS. 2A-2B, or as an embodiment of a flex antenna, similar to that depicted in FIGS. 4A-4C. In an embodiment, hybrid circuit 600 has leads to couple to antenna 610, similar to that depicted in FIG. 5.

Match filter 620 provides for matching the complex impedance of the antenna to the impedance of RF drive circuit 630. Signal processing unit 640 provides the electronic circuitry for processing received signals via antenna 610 for wireless communication between a hearing aid in which hybrid circuit 600 is configured and a source external to the hearing aid. The source external to the hearing aid can be used to provide information transferal for testing and programming of the hearing aid. Signal processing unit 640 may also provide the processing of signals representing sounds, whether received as acoustic signals or electromagnetic signals. Signal processing unit 640 provides an output that is increased by amplifier 650 to a level which allows sounds to be audible to the hearing aid user. Amplifier 650 may be realized as an integral part of signal processing unit 640. As can be appreciated by those skilled in the art upon reading and studying this disclosure, the elements of a heating aid housed in a hybrid circuit that includes an integrated antenna can be configured in various formats relative to each other for operation of the hearing aid.

The elements of hybrid circuit 600 are implemented in the layers of hybrid circuit 600 providing a compact circuit for a hearing aid. In an embodiment, a hearing aid using a hybrid circuit shown as hybrid circuit 600 is a CIC hearing aid operating at a frequency of about 916 MHz for wireless communication exterior to the hearing aid. In an embodiment, the antenna for the CIC hearing aid operating at a frequency of about 916 MHz is configured in a hybrid circuit as a substrate based planar antenna. In another embodiment, the antenna for the CIC hearing aid operating at a frequency of about 916 MHz is configured in a hybrid circuit as a flex antenna. Various embodiments of hybrid circuit 600 may operate at different frequencies covering a wide range of operating frequencies.

Figure 7:
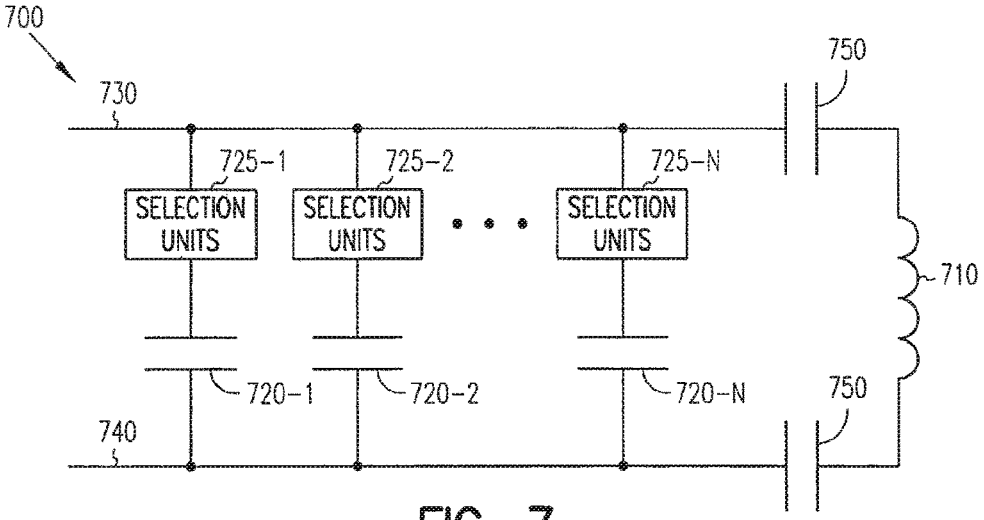
FIG. 7 shows an embodiment of a capacitor network coupled to an antenna configured within a hearing aid, in accordance with the teachings of the present invention.

FIG. 7 shows an embodiment of a capacitor network 700 coupled to an antenna 710 configured within a hearing aid. Capacitor network 700 allows antenna 710 to be tuned by selectively coupling one or more capacitors 720-1, 720-2 . . . and/or 720-N to antenna 710. Capacitor network 700 may be arranged as a capacitor ladder. Though shown as a network of parallel capacitors, capacitor network 700 may be realized as a network of capacitors in series. In various embodiments, series and/or parallel capacitors may be included in a capacitor network. The selection of capacitors may be controlled by enabling one or more selection units 725-1, 725-2 . . . and/or 725-N. Selection units 725-1, 725-2 . . . 725-N may be transistors configured as transmission gates that electrically couple its corresponding capacitor 720-1, 720-2 . . . 720-N to antenna 710 at the leads 730, 740. Selection units 725-1, 725-2 . . . 725-N be configured as transmission gates using metal oxide semiconductor (MOS) related technology, bipolar junction transistor (BJT) related technology, or logic circuitry incorporating one or more microelectronic technologies. The enabling signals, power circuitry, or other detailed circuitry for selection units 725-1, 725-2 . . . 725-N are not shown to focus on the application of the selection unit to couple one or more capacitors 720-1, 720-2 . . . 720-N to antenna 710. Values for each of the capacitors 720-1, 720-2 . . . 720-N can be chosen based on the application in a particular hearing aid. In an embodiment, each capacitor 720-1, 720-2 . . . 720-N has a different capacitance value. In an embodiment, each capacitor 720-1, 720-2 . . . 720-N has the same capacitance value. Leads 730, 740 may be conductive traces on a substrate of a hybrid circuit in the hearing aid.

Various embodiments include tuning series capacitors 750 to provide for application in different parts of the world. The tuning capacitors allow the antenna to be tuned between about 902 MHz and about 928 MHz. This tuned frequency range may be used in the United States and Canada. The tuning capacitors allow the antenna to be tuned between about 795 MHz and about 82.0 MHz. This tuned frequency range may be used in China and Korea. The tuning capacitors allow the antenna to be tuned to about 965 MHz or above. This tuned frequency range may be used in Taiwan. The configuration of tuning capacitors is not limited to any particular range, but may be adapted to a frequency range for the particular application of an embodiment of an antenna in a hearing aid. In an embodiment, tuning capacitors are configured in a parallel arrangement.

Various embodiments for antennas configured within the housing of hearing aid may be realized. Embodiments also may include coupling the antennas arranged in the hearing aid with matching circuit or matching circuit elements. The matching circuit or element may be adapted to match the complex conjugate of the complex impedance of the associated antenna. The matching circuit may be realized using different approaches including but not limited to using a transformer, a balun, a LC circuit match, a shunt capacitor, or a shunt capacitor and a series capacitor. Various embodiments for the matching circuit use inductances ranging from 10 nanohenrys to 40 nanohenrys and other embodiments use inductances ranging from 30 to 40 nanohenrys. Various embodiments for the matching circuit use capacitances of the order of 80 femtofarads. The shunt capacitor can be realized as a capacitor network as discussed with respect to FIG. 7. Providing a match circuit or matching circuit elements helps to reduce loss associated with the antenna. In an embodiment, a −15 to −25 db antenna or a −15 to −20 db antenna may be realized. Selecting the proper element sizes for a match circuit may be conducted through a Smith chart analysis and/or appropriate simulation techniques such as a finite element analysis.

In an embodiment, an antenna for a hearing aid is adapted for operation in the near field environment. Such an arrangement may occur for antennas in a hearing aid used to communicate using a RF signal with another hearing aid worn by the same person or with a programming device that can be carried on the person wearing the hearing aid. In an embodiment, the effects of a person's head are taken into consideration in the design of the hearing aid to be incorporated in a hearing aid.

The head is essentially a non-magnetic material. However, the electric field of an RF signal is attenuated through the head, and it is attenuated through air. The level of attenuation through the head may be a slightly greater than it is through the air. Antennas that utilize an embodiment of this design attenuate signals less during passage through high dielectric constant materials, such as the brain, muscle, and tendon, than antennas not constructed under this principle. Body dielectric constants and loss tangents are utilized more effectively in this manner, opening up the passage of data through these materials with this method.

With an antenna for a hearing aid located close to a person's head, the quality factor, Q, which is related to the ratio of the frequency of the carrier signal and the bandwidth of the signal, drops. In an embodiment, the Q of an antenna is designed at a higher Q than desired such that when operating in a hearing aid located on an individual, the antenna has a lower Q, where the lower is within the desired operating range. In an embodiment, an antenna is configured as embedded in a dielectric material such that the configuration of the antenna including the choice of dielectric material is designed to compensate for the reduction of the antenna Q due to the proximity of the individual's head. In an embodiment, the antenna configuration in the hearing aid is adapted to compensate for the Q reduction provided by proximity of the user's head with air used as the dielectric medium.

In an embodiment, the tuning of the antenna is accomplished in an iterative fashion. The antenna of the hearing aid is tuned to a Q higher than the desired operating Q. The antenna is tested in an operating environment for the hearing aid. In an embodiment, the antenna is tested in the operating environment with the hearing aid worn by a person. In an embodiment, the antenna is tested in the operating environment with the hearing aid having the antenna placed in a model of a person's head, in which the model is configured with the electromagnetic characteristics of a person's head. The antenna Q is further tuned either higher or lower depending on the test results. With the antenna Q initially sent higher than the operating Q, tuning may be realized by decreasing the Q in small increments. The tuning of the antenna in an iterative bench tuning process is a form of adaptive tuning or pre-emptive tuning. The antenna is tuned outside the proximity of a person's head such that the antenna is tuned wrong, that is, tuned so that is not correctly, fully tuned in air. With interjection into the ear or in proximity to the ear depending on the type of hearing aid, it is tuned to the desire operating conditions. The hearing aid antenna may be tuned automatically either while being worn by a person (or equivalently mounted in a model of a person's head) or at a lab bench.

The testing of the antenna for the hearing aid can be accomplished by transmitting a known test script to the hearing aid. The reception of the test script is evaluated with respect to bit errors using a bit error computation. If no bit errors occur, the antenna can be detuned until there are bit errors followed by tuning it again. The tuning may be realized through the adjustment in a matching circuit coupled to the antenna. In a matching circuit using capacitors, the tuning includes the change of capacitance value. In an embodiment, the capacitance can be changed by selectively including capacitors using a capacitance network similar to that shown in FIG. 7. Other embodiments may use other mechanisms for tuning the antenna.

Figure 8:
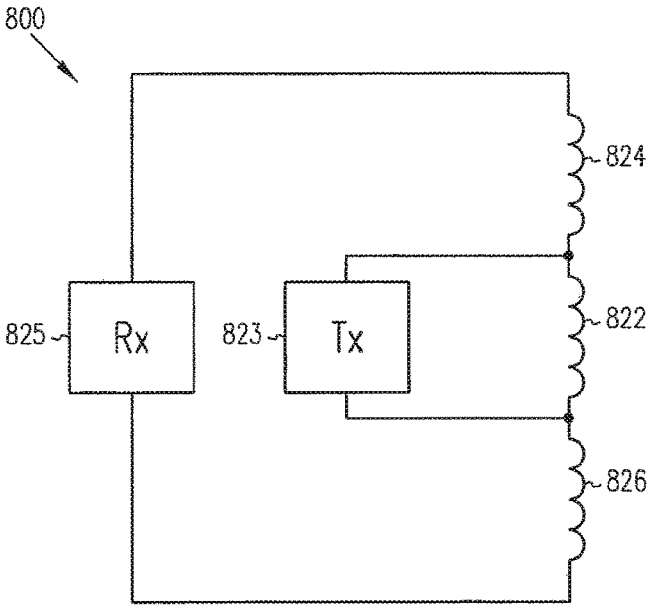
FIG. 8 shows a representation of an embodiment of a hearing aid in which an antenna is driven on a middle turn by a drive circuit in the hearing aid with two outside turns coupled to receiver circuits to receive power from the middle turn, in accordance with the teachings of the present invention.

Testing of the antenna for the hearing aid may include testing of power in the antenna. FIG. 8 shows a representation of an embodiment of a hearing aid 800 in which the antenna is driven on a middle turn 822 by a drive circuit 823 in hearing aid 800 with the two outside turns 824, 826 coupled to receiver circuit 825 to receive power from the middle turn. In an embodiment, the middle turn and the two outside turns are connected as part of a loop having high conductivity. By coupling power into one of the outside turns, the power of the antenna using the middle turn can be measured. The coupling may be an inductive coupling. The turns 822, 824, and 826 and circuits 823 and 825 may be adapted to measure RF power from turn 822. Drive circuit 823 and receiver circuit 825 may be configured as a single circuit. An antenna configured as a middle turn may be coupled to circuits in hearing aid 800 by use of contact vias, and outside turns configured as receiver antennas may be coupled to circuits in hearing aid 800 by use of contact vias. With flex antennas, turns can be coupled to circuits in the hearing aid by coupling the conductive material in the flex antennas to contacts in the hybrid circuit, by coupling the conductive material in the flex antennas directly to traces or metallization paths in the hybrid circuit or by using coupling wires.

Hearing aid 800 may include circuitry to process and evaluate the power measurement of the antenna based on signals from drive circuit 823 and receiver circuits 825, 827. Alternatively, data from drive circuit 823 and receiver circuits 825, 827 may be provided to systems outside hearing aid 800 for evaluation. Communication of this data may be realized through wireless communication or through wired communication.

Figure 9:
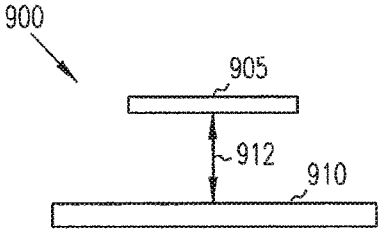
FIG. 9 shows a representation of an embodiment of a hearing aid in which a conductive line is situated in close proximity to an antenna embedded in the hearing aid to measure power from the antenna, in accordance with the teachings of the present invention.

FIG. 9 shows a representation of an embodiment of a hearing aid 900 in which a conductive line 905 is situated in close proximity to an antenna 910 embedded in the hearing aid 900 to measure power from antenna 910. In an embodiment, conductive line 905 and antenna 910 are configured at a distance 912 such that sufficient RF power is coupled from antenna 910 into line 905 to measure the power of antenna 910. In an embodiment, distance 912 ranges from about 10 mils to about 20 mils. Conductive line 905 and antenna 910 may be adapted for inductively coupling power between the two. Hearing aid 900 may include circuitry to process and evaluate the power measured from conductive line 905. Alternatively, data obtained from coupling power directly into conductive line 905 may be provided to systems outside hearing aid 800 for evaluation. Communication of this data may be realized through wireless communication or through wired communication.

Figure 10A:
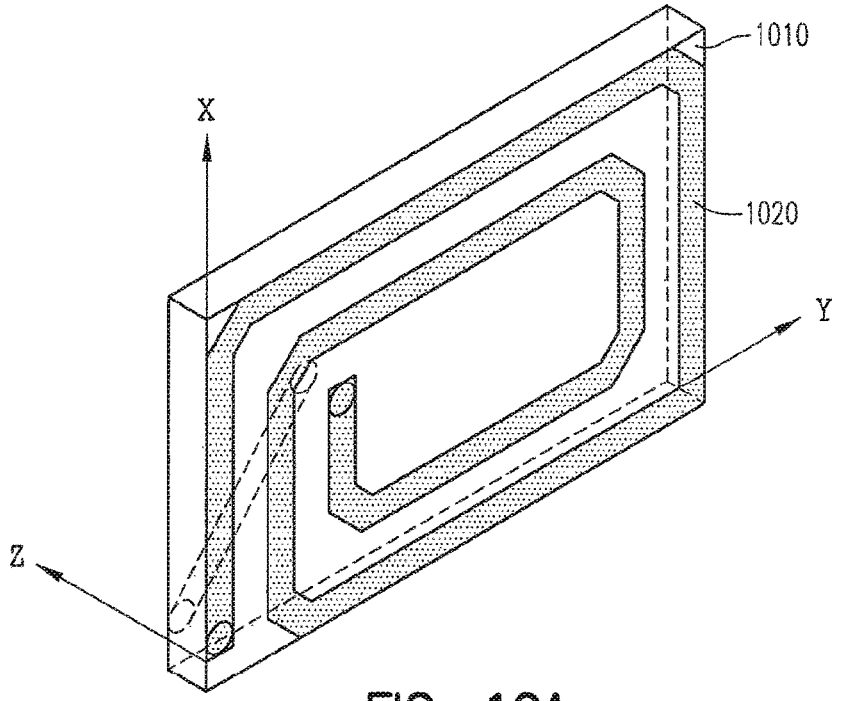
FIGS. 10A-10D illustrate embodiments of antenna configurations in a hearing aid, in accordance with the teachings of the present invention.

FIGS. 10A-10D illustrate embodiments of an antenna for a hearing aid. FIG. 10A illustrates an antenna 1020 formed in substrate 1010. In an embodiment, antenna 1020 is configured as a spiral. In an embodiment, antenna 1020 is configured with approximately the same size as the hybrid circuit (not shown) that can be mounted below or above antenna 1020 in a hearing aid.

Figure 10B:
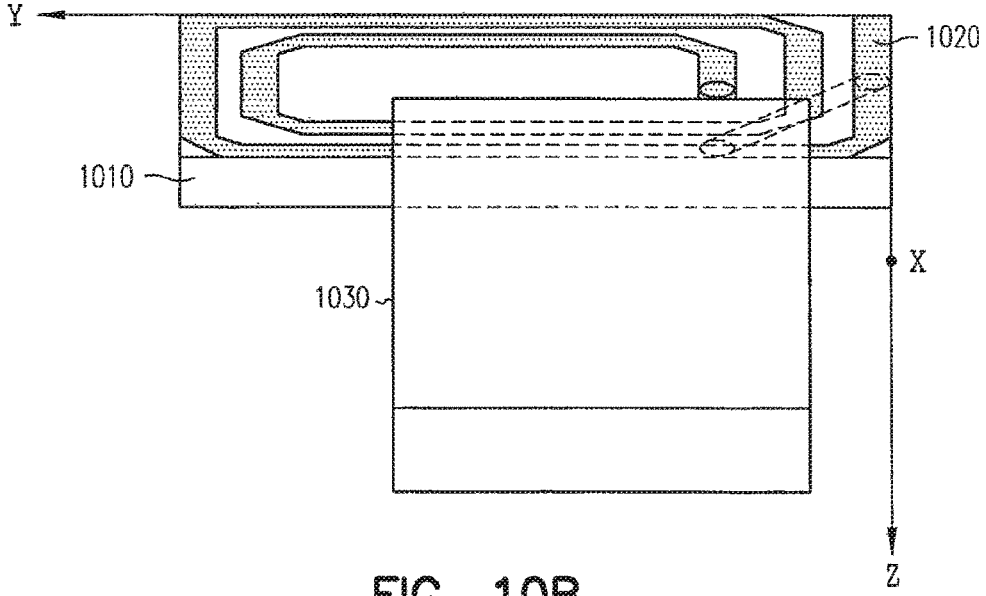

FIG. 10B illustrates antenna 1020 of FIG. 10A mounted on top of a hybrid circuit 1030 in a "Top Hat" configuration. In an embodiment, antenna 1020 is displaced from hybrid circuit 1030 by approximately 15 mils. Such a displacement is provided to eliminate or reduce proximity effects of hybrid circuits. In an embodiment, the size of antenna 1020 may be larger than that of hybrid circuit 1030.

Figure 10C:
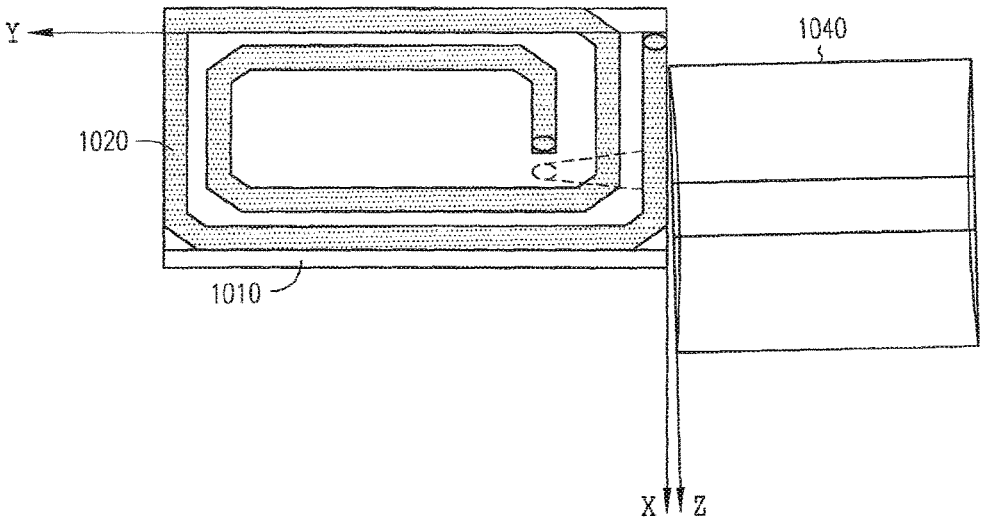

FIG. 10C illustrates an antenna displaced to one side from a hybrid circuit. In an embodiment, antenna 1020 of FIG. 10A is employed with hybrid circuit 1040. In an embodiment, hybrid circuit 1040 may be constructed similar to hybrid circuit 1030 of FIG. 10B. Displacement to the side of hybrid circuit 1040 provides space between hybrid circuit 1040 and antenna 1020 in a horizontal plane (loop plane). Such a configuration also attenuates proximity effects of hybrid circuit 1040 on hearing aid antenna 1020.

Figure 10D:
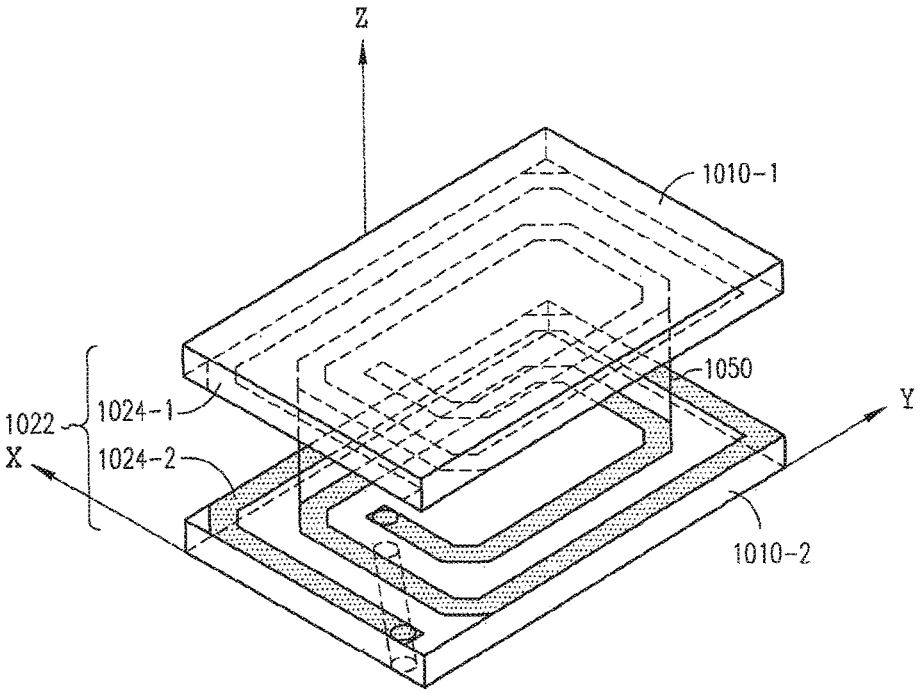

FIG. 10D illustrates an antenna 1022 on both sides of a hybrid 1050. In an embodiment, hybrid circuit 1050 may be constructed similar to hybrid circuit 1030 of FIG. 10B. In an embodiment, antenna 1022 has two turns 1024-1 on substrate 1010-1 and 1024-2 on substrate 1010-2, where the two turns 1024-1, 1024-2 are on two different sides of hybrid 1050. This configuration effectively adds a z-component to the transmitted wave polarization from antenna 1020.

Embodiments may include various combinations of the configurations shown in FIGS. 10A-10D for a hearing aid antenna. For example, such combinations may include the relative size relationship of the antenna to the hybrid as discussed with respect to FIG. 10A with the placement on both sides of hybrid shown in FIG. 10D.

For placement of the various embodiments for hearing aid antennas in the body, such as for CIC transceivers, design of the antenna parameters may be performed to minimize proximity effects of the human body. Such a design method may consider material effects of the ear canal, brain, associated bone and connective tissue, and other parts of the human body through which these signal inevitably pass. Such consideration may be important for embodiments in which signals are passed from one ear to the other ear. An antenna parameter that may be considered includes the orientation of the antenna to avoid the proximity effect of the human body, since human body effects are not limited to the ear canal, but may include the volume of the entire body, which may affect the radio signal. In embodiments for hearing aid, a transmitting antenna to communicate with a hearing aid may be configured as a loop antenna having placement in a pocket, attached to a belt, on a side position such as a "holster" position, for example.

Mitigation of proximity effects of the body itself may be treated by simulation of the human body tissue parameters placed to represent the human body tissue as the tissue would be situated in a real environment. In an embodiment, parameters may be given a particular placement to simulate buttressing these tissue positions against antennas in various orientations. Various embodiments include simulating these buttressing positions to evaluate hearing aids. In an embodiment, buttressing positions are simulated to evaluate BTE hearing aids, which rest against the ear and side of the skull.

Antennas configured in hybrid circuits adapted for use in hearing aids according to various embodiments provides a compact design for incorporating a wireless link into small hearing aids. The integrated structure of the antenna in the hybrid circuit allows for the elimination of soldering a separate antenna to a hearing aid during manufacture. Embodiments of the antenna can be utilized in completely-in-the-canal hearing aids providing a wireless link over several meters at small input power.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of embodiments of the present invention. It is to be understood that the above description is intended to be illustrative, and not restrictive and that the phraseology or terminology employed herein is for the purpose of description and not of limitation. Combinations of the above embodiments and other embodiments will be apparent to those of skill in the art upon studying the above description. The scope of the invention includes any other applications in which embodiments of the above structures and fabrication methods are used. The scope of the invention should be determined with reference to the appended claims, along with the full scope of equivalents to which such claims are entitled.

What is claimed is:

1. A hearing aid comprising:

a hybrid circuit including a first substrate and a second substrate;

an antenna having metallic traces disposed in the hybrid circuit, wherein the antenna includes at least one turn on the first substrate and at least one turn on the second substrate;

an electronic device in the hybrid circuit coupled to the metallic traces of the antenna; and a signal processing unit to process information received and transmitted by the antenna, wherein the antenna is configured with a first turn to act as a transmitting antenna and a second turn outside the first turn to act as a receiving antenna, the second turn configured to inductively receive signals from the first turn for measurement of power in the first turn.

2. The hearing aid of claim 1, wherein the hearing aid includes a conductive line aligned along the antenna, the conductive line configured to measure the power in the antenna.

3. The hearing aid of claim 2, wherein the conductive line and the antenna are configured as inductively coupled loops.

4. The hearing aid of claim 1, further including an RF drive circuit coupled between the signal processing unit and the antenna.

5. The hearing aid of claim 1, wherein the electronic device includes a matching circuit coupled to the antenna, the matching circuit having an impedance that is substantially the complex conjugate of an impedance of the antenna to which it is coupled.

6. The hearing aid of claim 1, wherein the electronic device includes a capacitance network coupled to the antenna, the capacitance network configured to selectively couple a capacitance in parallel with the antenna.

7. The hearing aid of claim 1, wherein the electronic device includes a capacitance network coupled to the antenna, the capacitance network configured to selectively couple a capacitance in series with the antenna.

8. The hearing aid of claim 1, wherein the electronic device includes a capacitance network coupled to the antenna, the capacitance network configured to selectively couple a capacitance in parallel with the antenna and a capacitance in series with the antenna.

9. The hearing aid of claim 1, wherein the metallic traces of the antenna are configured as a number turns in a polyimide substrate.

10. The hearing aid of claim 1, wherein the metallic traces of the antenna are configured as a number turns in a low temperature cofired ceramic substrate.

11. The hearing aid of claim 1, wherein the metallic traces of the antenna are configured as a number turns in a quartz ceramic substrate.

12. The hearing aid of claim 1, wherein the antenna includes a flex circuit.

13. The hearing aid of claim 12, wherein the flex circuit includes flexible metallic traces in a polyimide layer.

14. The hearing aid of claim 1, wherein the metallic traces of the antenna have a width and a combined length to provide a selected operating distance for a selected input power.

15. The hearing aid of claim 14, wherein the selected operating distance for a selected input power ranges from about 2 meters to about 3 meters for an input power ranging from about −10 dBm to about −20 dBm.

16. The hearing aid of claim 1, wherein the antenna is configured to operate with a carrier frequency ranging from about 400 MHz to about 3000 MHz.

17. A hearing aid comprising:

a housing;

an electronic circuit within the housing; and an antenna coupled to an electronic device within the housing, the antenna configured as a number of turns on a first and a second dielectric substrate of a hybrid circuit to provide wireless communication to the electronic circuit from a source exterior to the hearing aid, wherein the antenna is configured with a first turn on the first dielectric substrate to act as a transmitting antenna and a second turn outside the first turn, the second turn on the second dielectric substrate configured to inductively receive signals from the first turn for measurement of power in the first turn.

18. The hearing aid of claim 17, wherein the hearing aid includes a conductive line aligned along the antenna, the conductive line configured to measure the power in the antenna.

19. The hearing aid of claim 17, wherein the antenna is a 12 turn helix antenna.

20. The hearing aid of claim 17, wherein the antenna has a working distance of about 10 meters.

* * * * *